US005445587A

United States Patent [19]

Brown

[11] Patent Number: 5,445,587

[45] Date of Patent: Aug. 29, 1995

[54] LIQUID FILLABLE DUMBELL

[76] Inventor: Lori Brown, 26-19 141st St., Flushing, N.Y. 11354

[21] Appl. No.: 199,744

[22] Filed: Feb. 22, 1994

[51] Int. Cl.[6] ..... A63B 21/075

[52] U.S. Cl. ..... 482/108

[58] Field of Search ..... 482/105–109, 482/92, 93

[56] References Cited

U.S. PATENT DOCUMENTS

| | | | |
|---|---|---|---|
| 3,334,899 | 8/1967 | Bosko et al. | 482/108 |
| 4,029,312 | 6/1977 | Wright | 482/106 |
| 4,043,553 | 8/1977 | Suarez | 482/106 X |
| 4,072,308 | 2/1978 | Applegate | 482/904 X |
| 4,103,887 | 8/1978 | Shoofler | 482/106 |

*Primary Examiner*—Richard J. Apley

*Assistant Examiner*—John Mulcahy

*Attorney, Agent, or Firm*—Michael I. Kroll

[57] ABSTRACT

An improved barbell is provided, which consists of a hollow elongated handle. A pair of hollow bulbous enclosures are fluidly connected to opposite ends of the hollow elongated handle. A structure is provided for filling the hollow bulbous enclosures and the hollow elongated handle with a liquid to increase the weight thereof, so that a person can properly exercise to promote physical fitness. A means is provided for evenly distributing the liquid through the hollow bulbous enclosures and hollow elongated handle when being filled. After exercising the liquid may be poured out of the filling structure, leaving the hollow elongated handle and the hollow bulbous enclosures in a lightweight condition to be easily handled, transported and stored.

7 Claims, 2 Drawing Sheets

LIQUID FILLABLE DUMBELL

BACKGROUND OF THE INVENTION

1. Field of the Invention

The instant invention relates generally to exercising devices and more specifically it relates to an improved barbell.

2. Description of the Prior Art

Numerous exercising devices have been provided in prior art. For example, U.S. Pat. No. 3,231,270 to Winer; U.S. Pat. No. 3,311,374 to Wittenberg et al.; U.S. Pat. No. 4,029,312 to Wright; U.S. Pat. No. 4,076,236 to Ionel; U.S. Pat. No. 4,103,887 to Shoofler; U.S. Pat. No. 4,361,324 to Barni; U.S. Pat. No. 4,905,992 to McWain and U.S. Pat. No. 4,913,422 to Elmore et al. all are illustrative of such prior art. While these units may be suitable for the particular purpose to which they address, they would not be as suitable for the purposes of the present invention as heretofore described.

Winer, Marvin

BAR BELL HAVING COLLAPSIBLE CHAMBERS

U.S. Pat. No. 3,231,270

A bar bell comprising an elongated bar with a variable volume fluid chamber at each end of the bar. The bar extends centrally through each fluid chamber. Each fluid chamber has a first fixed portion and a second collapsible, movable portion that is continuously movable along the bar from a minimum volume position to a maximum volume position and vice versa. The bar has readily visible exposed indicia registering with a point on the second movable portion of each fluid chamber to indicate the volume of the fluid chamber at any position of the second movable portion and hence to indicate the weight of fluid within the fluid chamber.

Wittenberg, Edward H.

Wittenberg, Irving E.

VARIABLE WEIGHT BAR BELL EXERCISING DEVICE

A weight lifting exercise device comprising an elongated handle and a pair of chamber forming hollow bulbous members spaced apart at opposite ends of the elongated handle. The bulbous members are thin walled and each are comprised of a pair of mating deeply concave shells and secured to each other along an annular seam. The seams lie in spaced apart parallel planes and extend perpendicular to the longitudinal axis of the handle at opposite ends thereof. A reinforcing plate lies between each pair of the mating shells in the plane of the seams and is secured thereto. A stop structure on the handle is spaced inwardly from each end thereof by a distance just slightly in excess of the concave depth of the innermost of the mating shells. A central opening is in the innermost of the mating shells of each of the pair of shells. A central opening is in each of the reinforcing plates. The handle extends with a close slide fit into the opening in the shell so that the innermost shell rests against the stop structure. The handle also extends with a close slide fit through the central opening in the reinforcing plate and is rigidly secured thereto. An opening in the other and outermost of the mating shells of each of the pairs of shells is for introduction of a weight-adding material to each of the bulbous members. A removable closure is for the opening. Communicating ports between the chambers in the bulbous members are defined by the shells and reinforcing plate for passage of the weight-adding material.

Wright, Forrest S.

EXERCISING DEVICE

U.S. Pat. No. 4,029,312

A weight-lifting or exercising device wherein the spacing of the weights along the length of the bar and the masses of the individual weights may be selectively varied to accommodate people of different sizes and capabilities. Each of the weights is substantially hollow and includes a generally ovoid or egg-shaped shell. Each shell has a first axis, a central aperture transverse to the first axis, and tubular member aligned with the axis and extending across the aperture. A channel opens at one longitudinal end of the shell and extends along the axis and through the tubular member for telescopically receiving the bar therein. The aperture is adapted to receive a person's hand or foot to operatively engage the tubular member for exercising purposes and the weights may be used without the bar as individual dumbbells. The shells may be telescoped along the bar and selectively locked at spaced locations along its length. The shells also include compartments which can be filled or emptied of foreign materials such as water, sand, shot or the like to selectively increase or decrease the mass of the individual weights.

Ionel, Stefan

BAR-BELL TYPE EXERCISING DEVICE

U.S. Pat. No. 4,076,236

The invention relates to a hantel easy to transport and store and the weight of which can be adapted at will. This hantel comprises a handle and at least two hollow bodies each connected, in a removable way, to one end of the handle. A plug closes tightly each hollow body which may be filled with water or other materials for use.

Shoofler, Renald

BARBELL WITH COLLAPSIBLE LOAD CARRYING CHAMBERS

U.S. Pat. No. 4,103,887

Portable barbell apparatus is disclosed comprising a collapsible enclosure made of a synthetic polymeric material. The enclosure has a base and an aperture for filling the enclosure. The center of gravity of the enclosure is between the aperture and the base. An opening is provided in the enclosure for receiving the end of a weight supporting bar. The opening is positioned in between the center of gravity and the aperture. This arrangement allows for the positioning of a pair of the enclosures on either end of a weight supporting bar after which the enclosures may be filled with water, sand or other particulate material so that the assembly may be employed as a barbell. When not in use, the enclosures may be removed from the weight supporting bar, emptied and conveniently transported and/or stored. The aperture comprises a slit and has a resilient member extending around the periphery thereof to resiliently bias the slit to a closed position.

Baroi, Stephan I.

APPARATUS FOR PHYSICAL CULTURE AND PHYSIOTHERAPY

U.S. Pat. No. 4,361,324

The apparatus for physical culture and physiotherapy comprises a set of different hollow interchangeable members made from a plastics material. It comprises, for example, two hollow bodies, each having the filling opening scaled by a plug and two tubular skirts having on their outer or inner walls respectively a thread which constitutes a coupling. The two hollow bodies are fixed to the ends of a connecting bar formed by the assembly of three rectilinear elements in order to form a dumb-bell. The latter also has at its ends two supplementary hollow bodies, identical to the two first hollow bodies and separated therefrom by a supplementary rectilinear element. A sleeve is mounted so as to rotate freely on each of the two supplementary rectilinear elements, so as to provide a more complete apparatus and offering more different possibilities of use than a conventional dumb-bell.

McWain, Richard J.

COLLAPSIBLE WEIGHT SYSTEM

U.S. Pat. No. 4,905,992

A collapsible weight system provides a collapsible/expandable diaphram for containing a liquid which includes a closed hub disclosed on one end thereof and an open hub disposed on another end thereof. A tubular cap is provided to seal the collapsible/expandable diaphragm while engaging both the closed hub and the open hub to provide axial support of the diaphragm a pin locking system is provided in order to lock the tubular cap to a bar for lifting the weights. When the bar is engaged and locked with the cap, it extends therethrough providing additional strength and support for the collapsible/expandable diaphragm.

Elmore, Connie

Elmore, Jennifer C.

Elmore, John-Michael

Elmore, Michael R.

BARBELL HAVING HOLLOW INTERLOCKING WEIGHTS

U.S. Pat. No. 4,193,422

In one embodiment of the present invention, a tubular body defines a handle and sleeves at each end of the tubular body. Hollow fillable add-on weights include an outer wall that defines an annular step that is sized to be received within a sleeve of the tubular body. The add-on weights are engaged with the tubular body by a peg and thru-hole or dimple arrangement that holds the add-on weights against rotation and axial separation within the sleeve of the tubular body. The add-on weights and hollow body combine to form an annular indentation around which a strap-on weight can be fastened. The strap-on weight includes a hollow flexible elongated pouch, one surface of which includes a recess having a fill nozzle projecting therefrom onto which a cap can be mounted for filling the hollow pouch with water, sand or other suitable material. An attachment strap extends from one end of the pouch and includes a number of snap-on holes spaced along the length of the strap. The surface of the pouch also includes a pair of raised buttons projecting from a reinforced wall of the hollow pouch onto which the holes in the strap are snapped so that the pouch can be retained in an encircling relationship.

SUMMARY OF THE INVENTION

A primary object of the present invention is to provide an improved barbell that will overcome the shortcomings of the prior art devices.

Another object is to provide an improved barbell which is hollow, so that it can receive a liquid to increase its weight, allowing a person to properly exercise with it, to help promote physical fitness and after exercising the liquid may be drained leaving the barbell in a lightweight condition to be easily handled, transported and stored.

An additional object is to provide an improved barbell that contains weight calibrated sight windows built into it, so that a person can see how to vary the weight by putting in the correct amount of liquid.

A further object is to provide an improved barbell that is simple and easy to use.

A still further object is to provide an improved barbell that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
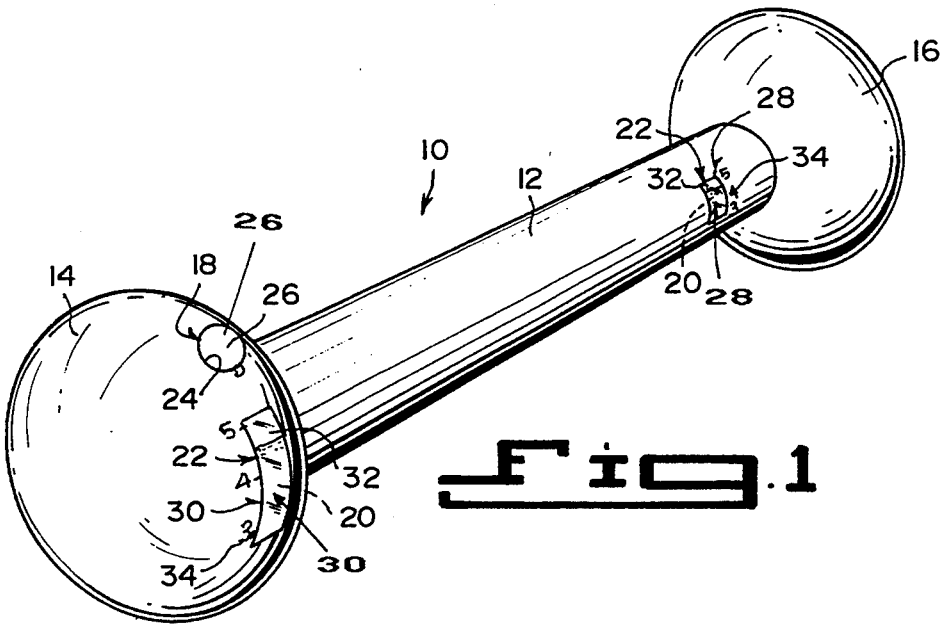
FIG. 1 is a left side perspective view of a first embodiment of the instant invention.

Turning now descriptively to the drawings, in which similar reference characters denote similar elements throughout the several views, FIG. 1 illustrates an improved barbell 10, which consists of a hollow elongated handle 12. A pair of hollow bulbous enclosures 14, 16 are fluidly connected to opposite ends of the hollow elongated handle 12. A structure 18 is for filling the hollow bulbous enclosures 14, 16 and the hollow elongated handle 12 with a liquid 20 to increase the weight thereof, so that a person can properly exercise to promote physical fitness. After exercising the liquid 20 may be poured out of the filling structure 18, leaving the hollow elongated handle 12 and the hollow bulbous enclosures 14, 16 in a lightweight condition to be easily handled, transported and stored.

An apparatus 22 is for visually indicating the amount of liquid 20 being filled therein, so that the person can see how to vary to weight by putting in the correct amount of liquid 20. The filling structure 18 includes the first hollow bulbous enclosure 14, having a top aperture 24 to allow the liquid 20 to enter and exit therefrom. A fill plug 26 is to seal closed the top aperture 24.

The visually indicating apparatus 22 consists of a first weight calibrated sight window 28 built into the hollow elongated handle 12. A second weight calibrated sight window 30 is built into the first hollow bulbous enclosure 14. The first and the second weight calibrated sight windows 28, 30 each include a curved transparent plate 32, so as to see the liquid 20 therebehind. A weight scale 34 is adjacent to the curved transparent plate 32, to indicate the weight amount of the liquid 20 retained therein.

The improved barbell 10, as shown in FIGS. 2 through 6 further include an assembly 36 within the hollow elongated handle 2 and the hollow bulbous enclosures 14, 16, for evenly distributing the liquid 20 therethrough when being filled.

The liquid evenly distributing assembly 36 includes a first bladder 38, with a neck portion 40 having a fill plug seal 42 carried within the first hollow bulbous enclosure 14, so that the fill plug seal 42 will fit into the top aperture 24 a second bladder 44 is carried within the second hollow bulbous enclosure 16. A fill tube 46 is carried within the hollow elongated handle 12 and is fluidly connected between one side of the neck portion 40 of the first bladder 38 and the second bladder 44. A partition 48 having a restricted fill orifice 50 extends across the neck portion 40 of the first bladder 14 below the connection of the fill tube 46. A liquid equalization tube 52 is carried within the hollow elongated handle 12 below the fill tube 46 and is fluidly connected between the first bladder 38 under the partition 48 and the second bladder 44. A fill vent tube 54 carried within the fill tube 46 is fluidly connected at one end to the second bladder 44. The other end extends into the neck portion 40 of the first bladder 38 and up to the fill plug seal 42.

Figure 2:
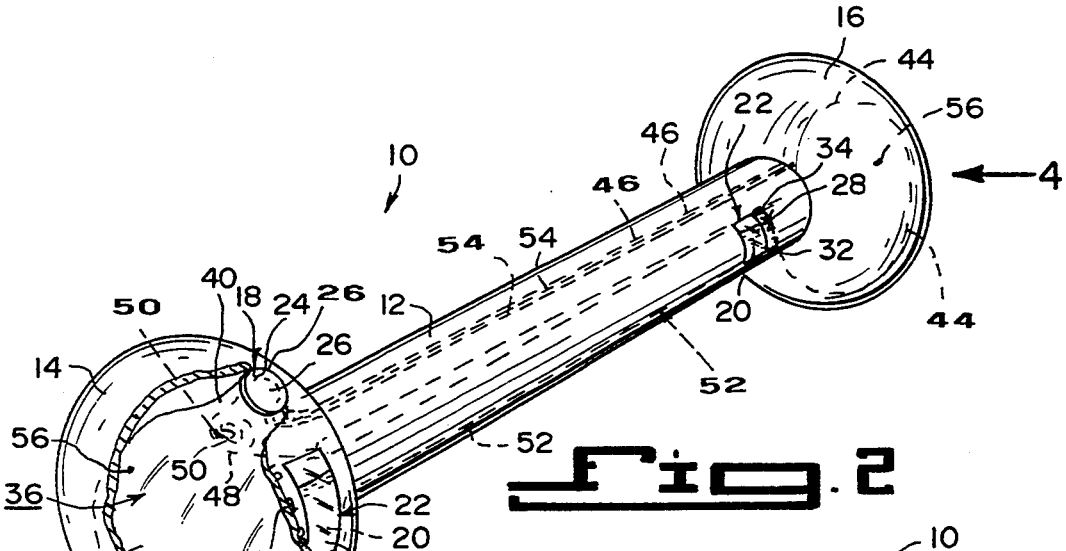
FIG. 2 is a left side perspective view of a second embodiment with parts broken away and some of the internal elements shown in dotted lines.
Figure 3:
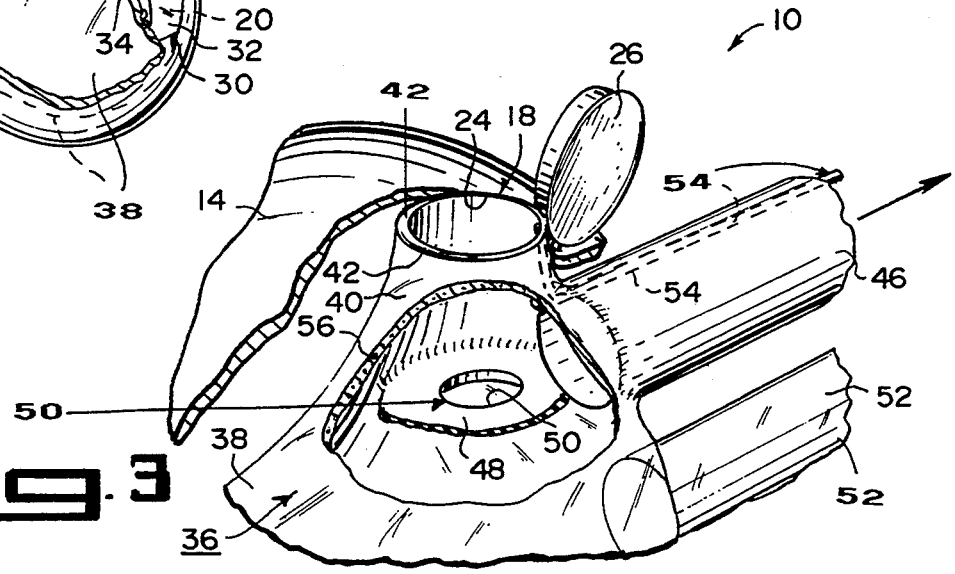
FIG. 3 is an enlarged left side perspective view of a portion of the second embodiment showing the fill plug seal therein.
Figure 4:
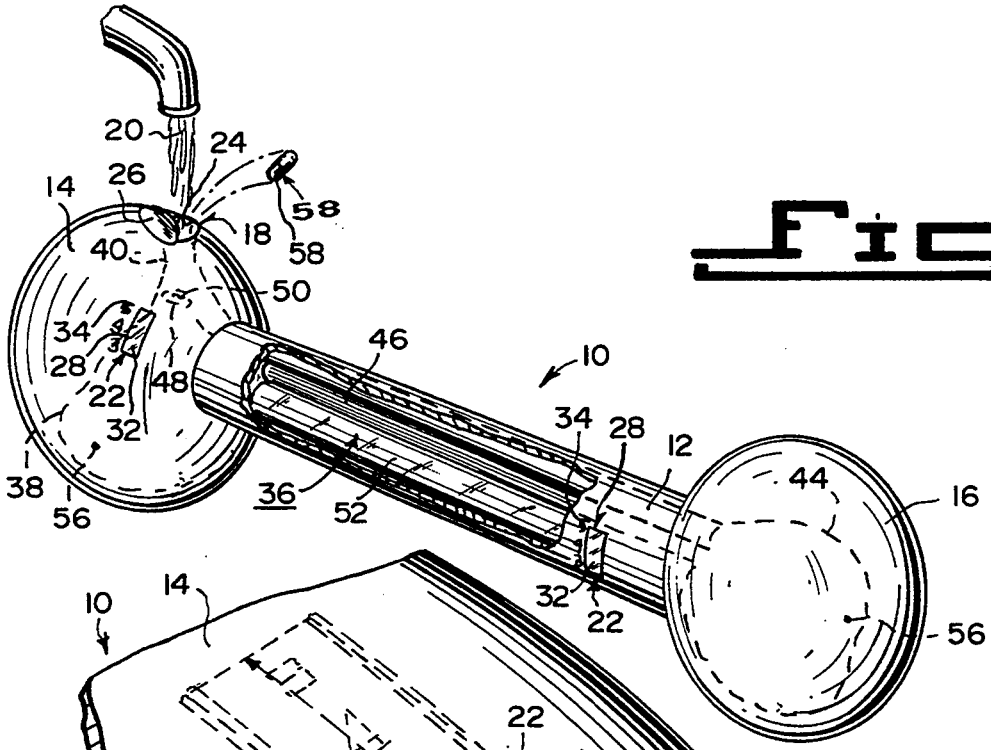
FIG. 4 is a right side perspective view taken in the direction of arrow 4 in FIG. 2 with parts broken away and some of the internal elements shown in dotted lines.

The first and the second bladders 38, 44 in FIGS. 2 through 4 are fabricated out of transparent expandable material 56. The visually indicating apparatus 22 is the same as in FIG. 1 and includes the first weight calibrated sight window 28 built into the hollow elongated handle 12. The second weight calibrated sight window 30 is built into the first hollow bulbous enclosure 14. The first and the second weight calibrated sight windows 28, 30 each include the curved transparent plate 32, so as to see the liquid 20 therebehind. The weight scale 34 is adjacent to the curved transparent plate 32, to indicate the weight amount of the liquid 20 retained therein.

FIG. 4 shows a color dye capsule 58 that can be deposited into the top aperture 24 in the first hollow bulbous enclosure 14. When the color dye capsule 58 dissolves in the liquid 20 therein a person can better see the liquid 20 through each curved transparent plate 22.

Figure 5:
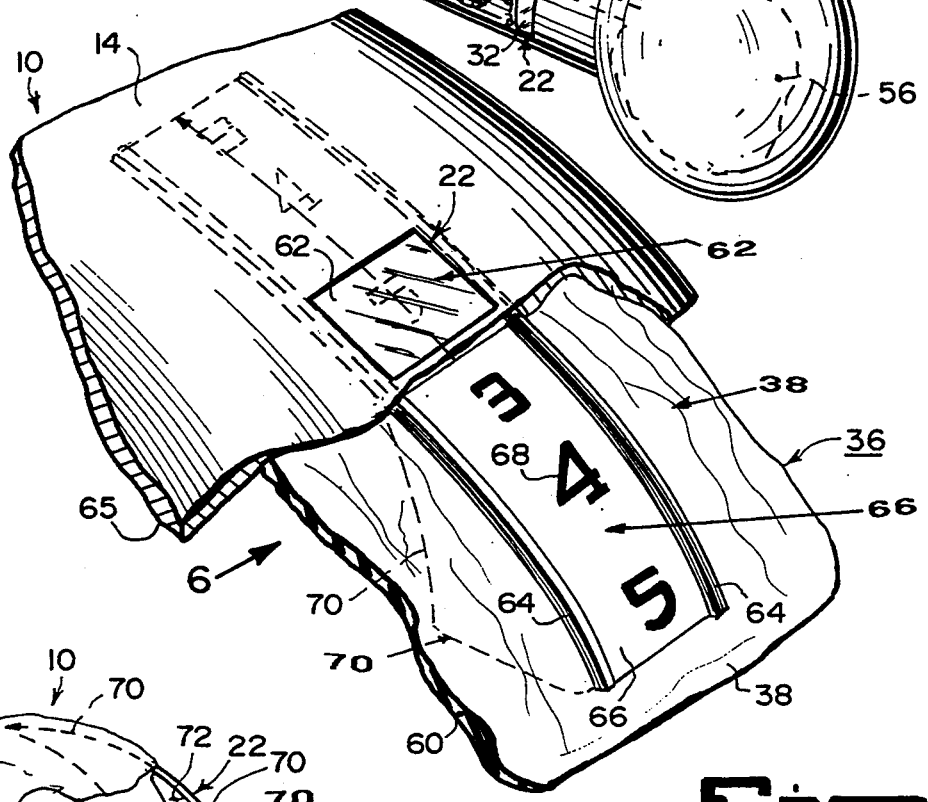
FIG. 5 is an enlarged perspective view of a portion of a third embodiment showing an alternative weight indicator therein.
Figure 6:
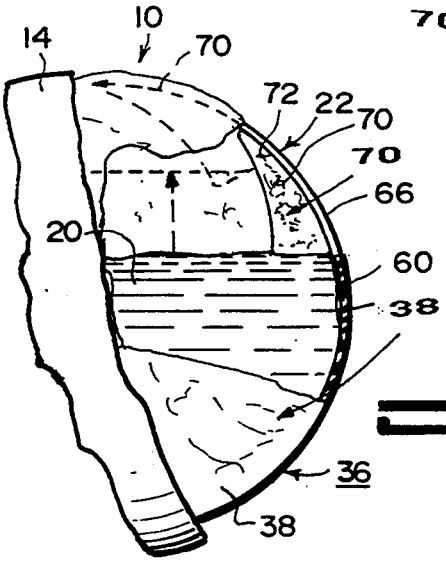
FIG. 6 is an elevational view of the third embodiment with parts broken away taken generally in the direction of arrow 6 in FIG. 5.

In FIGS. 5 and 6, the first and the second bladders 38, 44 are fabricated out of stretchable rubber material 60. The visually indicating apparatus 22 consists of a curved weight indication window 62 built into the first hollow bulbous enclosure 14. A pair of curved tracks 64 are built into a rear surface 65 of the first hollow bulbous enclosure 14 on opposite sides of the curved weight indication window 62. A curved weight indicator plate 66 is provided, having weight scale indicia 68 thereon. The curved weight indicator plate 66 slides within the curved tracks 64. A float 70 on a back surface 72 of the curved weight indicator plate 66 extends into and is affixed to the first bladder 38. When the liquid 20 enters the first bladder 38, the float 70 will rise causing the curved weight indicator plate 66 to slide upwardly in the curved tracks 64, to allow a person to see the proper weight scale indicia 68 through the curved weight indication window 62.

LIST OF REFERENCE NUMBERS

10 improved barbell
12 hollow elongated handle
14 first hollow bulbous enclosure
16 second hollow bulbous enclosure
18 filling structure
20 liquid
22 visually indicating apparatus 22
24 top aperture in 14
26 fill plug
28 first weight calibrated sight window in 12
30 second weight calibrated sight window in 14
32 curved transparent plate
34 weight scale adjacent 32
36 liquid evenly distributing assembly
38 first bladder in 14
40 neck portion of 38
42 fill plug seal on 40
44 second bladder in 16
46 fill tube in 12
48 partition in 40
50 restricted fill orifice
52 liquid equalization tube in 12
54 fill vent tube in 46
56 transparent expandable material for 38, 44
58 color dye capsule
60 stretchable rubber material for 38, 44
62 curved weight indication window
64 curved track on 65
65 rear surface of 14
66 curved weight indicator plate
68 weight scale indicia on 66
70 float
72 back surface of 66

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An improved barbell which comprises:

a) a hollow elongated handle;

b) a pair of hollow bulbous enclosures fluidly connected to opposite ends of said hollow elongated handle;

c) means for filling said hollow bulbous enclosures and said hollow elongated handle with a liquid to increase the weight thereof, so that a person can properly exercise to promote physical fitness and after exercising the liquid may be poured out of said filling means leaving said hollow elongated handle and said hollow bulbous enclosures in a lightweight condition to be easily handled, transported and stored, said filling means including said first hollow bulbous enclosure having an aperture to allow the liquid to enter and exit therefrom, and a fill plug to seal close said aperture;

d) means for visually indicating the amount of liquid being filled therein, so that the person can see how to vary the weight by putting in the correct amount of liquid, said visually indicating means including a first weight calibrated sight window built into said hollow elongated handle, and a second weight calibrated sight window built into said first hollow bulbous enclosure, said first and said second weight calibrated sight windows each including a curved transparent plate, so as to see the liquid therebehind, and a weight scale adjacent to said curved transparent plate to indicate the weight amount of the liquid retained therein; and e) means within said hollow elongated handle and said hollow bulbous enclosures for evenly distributing the liquid therethrough when being filled, said liquid evenly distributing means including a first bladder with a neck portion having a fill plug seal carried within said first hollow bulbous enclosure, so that said fill plug seal will fit into said aperture, a second bladder carried within said second hollow bulbous enclosure, a fill tube carried within said hollow elongated handle and fluidly connected between one side of said neck portion of said first bladder and said second bladder, a partition having a restricted fill orifice extending across said neck portion of said first bladder below the connection of said fill tube, a liquid equalization tube carried within said hollow elongated handle below said fill tube and fluidly connected between said first bladder under said partition and said second bladder, and a fill vent tube carried within said fill tube fluidly connected at one end to said second bladder, while other end extends into said neck portion of said first bladder and up to said fill plug seal.

2. An improved barbell as recited in claim 1, wherein said first and said second bladders are fabricated out of transparent expandable material.

3. An improved barbell as recited in claim 2, wherein said visually indicating means includes:

a) a first weight calibrated sight window built into said hollow elongated handle; and b) a second weight calibrated sight window built into said first hollow bulbous enclosure.

4. An improved barbell as recited in claim 3, wherein said first and said second weight calibrated sight windows each include:

a) a curved transparent plate, so as to see the liquid therebehind; and b) a weight scale adjacent to said curved transparent plate to indicate the weight mount of the liquid retained therein.

5. An improved barbell as recited in claim 4, wherein the liquid is dyed so that a person can better see the liquid through each said curved transparent plate.

6. An improved barbell as recited in claim 1, wherein said first and said second bladders are fabricated out of stretchable rubber material.

7. An improved barbell as recited in claim 6, wherein said visually indicating means includes:

a) a curved weight indication window built into said first hollow bulbous enclosure;

b) a pair of curved tracks built into a rear surface of said first hollow bulbous enclosure on opposite sides of said curved weight indication window;

c) a curved weight indicator plate having weight scale indicia thereon, whereby said curved weight indicator plate slides within said curved tracks; and d) a float on a back surface of said curved weight indicator plate extending into and affixed to said first bladder, so that when the liquid enters said first bladder, said float will rise causing said curved weight indicator plate to slide upwardly in said curved tracks, to allow a person to see the proper weight scale indicia through said curved weight indication window.

* * * * *